US005768935A

United States Patent [19]

Owens

[11] Patent Number: 5,768,935

[45] Date of Patent: Jun. 23, 1998

[54] BLADE CRIMPING DEVICE

[76] Inventor: Carl H. Owens, 5215 Phillips Hwy. #1, Jacksonville, Fla. 32207

[21] Appl. No.: 816,858

[22] Filed: Mar. 13, 1997

[51] Int. Cl.[6] ..... B21D 39/04

[52] U.S. Cl. ..... 72/416; 72/409.19; 29/237

[58] Field of Search ..... 72/416, 409.16, 72/409.01, 412, 409.19, 385; 29/237, 282, 283.5

[56] References Cited

U.S. PATENT DOCUMENTS

| | | | |
|---|---|---|---|
| 810,241 | 1/1906 | Wikstrom | 72/385 |
| 2,009,829 | 7/1935 | Williams | 72/409.01 |
| 2,832,244 | 4/1958 | Olson | 72/409.01 |
| 3,919,877 | 11/1975 | Netta | 72/416 |
| 4,337,635 | 7/1982 | Martin | 72/416 |
| 5,263,355 | 11/1993 | Malagnoux | 72/385 |

FOREIGN PATENT DOCUMENTS

| | | | |
|---|---|---|---|
| 33463 | 9/1912 | Sweden | 72/416 |

*Primary Examiner*—Daniel C. Crane
*Attorney, Agent, or Firm*—Thomas C. Saitta

[57] ABSTRACT

A device for attaching a hose onto tubing by crimping a sleeve ferrule against the hose and tube stem, the device having a pair of opposing crimper assemblies each having a number of slotted crimper blades aligned to form contiguously abutting blade pairs, where the slots diminish such that the ferrule is deformed as the crimper assemblies are advanced together. The crimper slots terminate in a semicircular portion so that at the point of full advancement a circle is formed by the opposing slots, resulting in a crimp with no raised longitudinal leak pathways.

10 Claims, 7 Drawing Sheets

BLADE CRIMPING DEVICE

BACKGROUND OF THE INVENTION

The invention relates in general to devices or tools for permanently attaching a fitting onto a hose, and more particularly to devices or tools which deformably crimp a sleeve ferrule mounted externally to a hose against a tubing stem which is disposed internally to a hose. More particularly, the invention relates to such devices which are relatively simple to operate, allow fittings to be attached to hoses or tubing having complicated or close configurations with little clearance, and which produce a crimp having no longitudinal leak pathways which may allow fluid to escape from the connection.

It is well known in the industry to join hoses to metal tubing or other devices having a stem capable of insertion into the bore of the hose by providing a sleeved ferrule with a collar or shoulder connected to the stem, such as at a bead lock comprising two adjacent annular shoulders on the stem or tubing, the ferrule being composed of a relatively thin, malleable metal such as aluminum or steel with a circular open end in the direction opposite to the collar to receive the hose. The stem is often barbed, grooved or beaded on the outer surface to provide a more secure connection. The hose is inserted onto the stem and inside the ferrule. The ferrule is then circumferentially compressed by a crimping machine or apparatus, such that the ferrule is deformed into a configuration having recesses and shoulders, the recesses pressing down onto the exterior of the hose, which in turn compresses the interior of the hose securely against the barbs, grooves or beads of the stem. With sufficient compression the hose is permanently connected to the stem of the tubing and will not separate even under high pressure applications, such as the pressures encountered in hydraulic fluid lines for heavy equipment.

A typical known apparatus for crimping a ferrule onto a hose comprises a set of radially movable dies disposed circumferentially around a central, circular opening. The hose-ferrule-stem assembly to be crimped is positioned at the central axis of the dies, which are radially advanced inwardly against the assembly, usually by powered drive means such as a hydraulic piston, cams, gears, etc. The crimping machines are usually rather massive and suffer from a design flaw which precludes their use in many situations. Modern equipment typically involves a large number of components, fluid lines, tubing, etc. which must be positioned in a compact area. This results in tubing and fitting configurations which are often complicated and convoluted with the tubing having a number of bends and curves, or with two or more tubing lines structured adjacent one another. With the known crimping apparati, tubing which is not generally linear for a sufficient distance to clear the crimping dies or tubing which is adjacent other tubing lines cannot be placed into the central opening of the machines. In addition, known crimping apparati produce crimps with longitudinal crimp shoulders between the crimp recesses. These longitudinal shoulders, where the hose is only minimally compressed between the stem and ferrule, provide a potential pathway for fluid loss.

It is an object of this invention to provide a crimping device for permanently connecting a hose to tubing having a stem and sleeve ferrule, to provide a device which is relatively simple in operation, to provide a device which requires only minimal clearance such that crimping can be accomplished on tubing having complicated configurations or multiple adjacent lines, and to provide a device which produces a crimp having no longitudinal leak pathways. It is a further object to provide such a device which utilizes a number of crimping blades rather than broad crimping dies to accomplish the crimp, which can be achieved in one linear operation. It is a further object to provide such a device where opposing sets of crimping blades produce multiple annular recesses around the full circumference of the ferrule, hose and stem.

SUMMARY OF THE INVENTION

The invention is a blade crimping device for permanently connecting a fluid hose made of a compressible material or combination of materials such as rubber, polymeric materials, or the like, to metal tubing or like objects having a stem portion for insertion into the bore of the hose and a sleeve ferrule made of a malleable yet relatively rigid material, such as aluminum or steel, attached to the stem or tubing and having an open end appropriately sized to receive the hose when the stem is inserted into the hose. Such hoses, tubing and sleeve ferrules are well known in the art. The blade crimping device comprises in general a first crimper assembly and a second crimper assembly, each of which comprises a base member which retains a number of crimper blades. The first set of crimper blades and the second set of crimper blades are positioned such that when the two crimper assemblies are advanced toward each other by drive means such as a hydraulic piston, threaded rod or the like, the crimper blades will align in adjacent, contiguous pairs. Each crimping blade has a crimping slot to partially surround and receive the ferrule-hose-stem assembly which is to be crimped. The crimping slot is defined by a relatively wide open end and an angled interior portion with diminishing width in the direction toward the interior of the blade, with the angled portion of the slot being terminated by a semi-circular portion. Each crimping slot has a bevelled side and radiused edge, and adjacent crimping blades are aligned such that the bevelled side of each adjacent blade is on the outer side of the pairing and the radiused edge of each adjacent blade is abutting. The outermost crimping blades on one of the crimper assembles are spaced slightly farther apart than the outermost set of crimping blades on the remaining crimper assembly, such that the most separated set of outermost blades on one crimper assembly will act to properly align the two crimper assemblies when abutted against the more closely disposed set of outermost blades on the other crimping assembly. The length of the crimping slot and the amount of the crimping blade which extends from the base member is constructed such that the crimper blades can be advanced toward each other to the point that the semi-circular portion of one crimping slot meets the semi-circular portion of the corresponding crimping slot to form a circle, with the base members acting as stops to prevent further advancement.

DETAILED DESCRIPTION OF THE INVENTION

With reference now to the drawings, the invention will be described in detail with particular regard for the best mode and preferred embodiment. The invention is in general a device for permanently attaching a hose made of compressible rubber, polymer or other similar material to a metal tube or the like by deformably crimping a sleeve ferrule or similarly configured fitting disposed externally to the hose, which in turn has the stem of the tubing disposed internally within its internal bore, the crimped ferrule compressing the hose material tightly against the tubing stem to preclude separation of the components.

Figure 4:
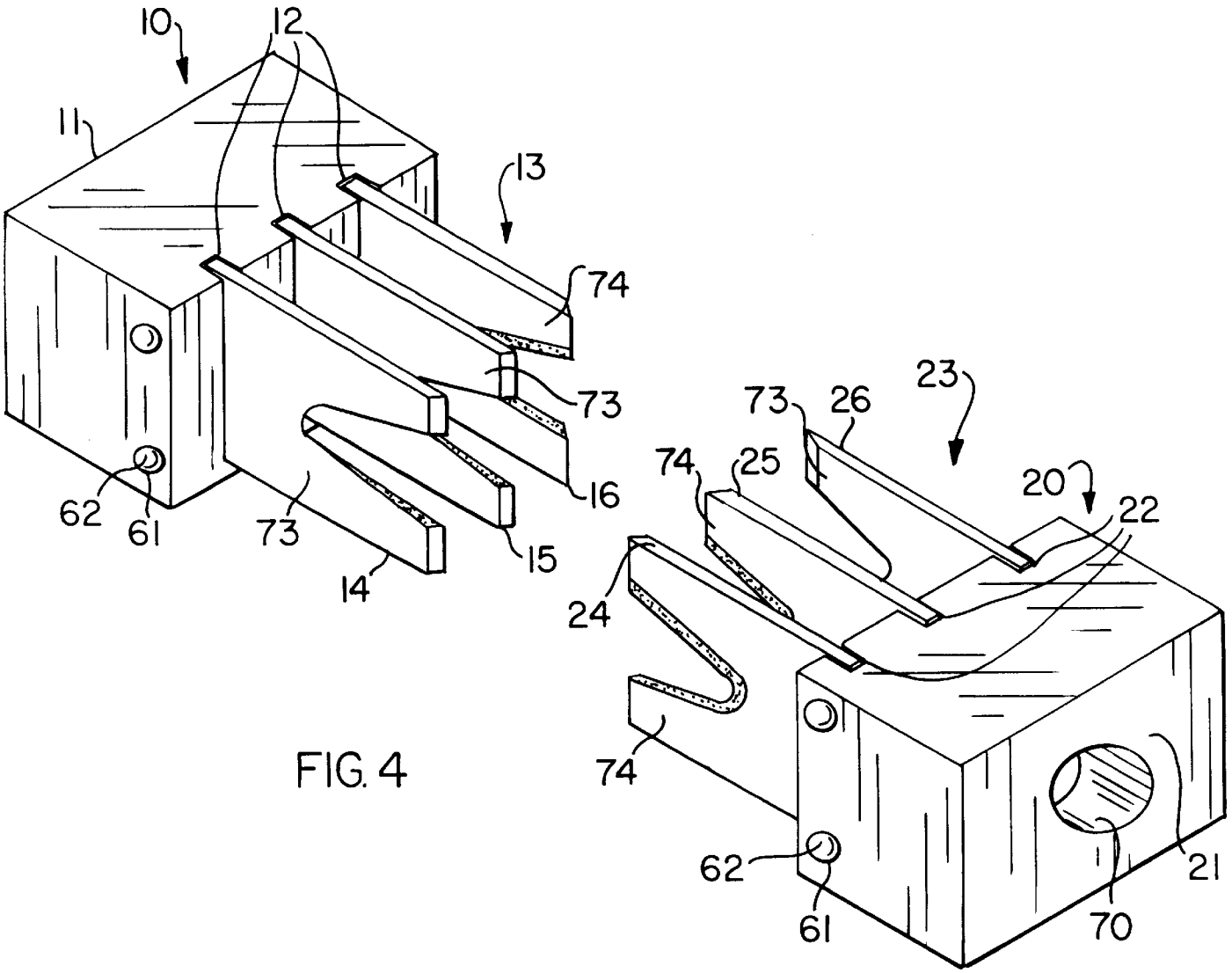
FIG. 4 is a perspective view of the invention.
Figure 5:
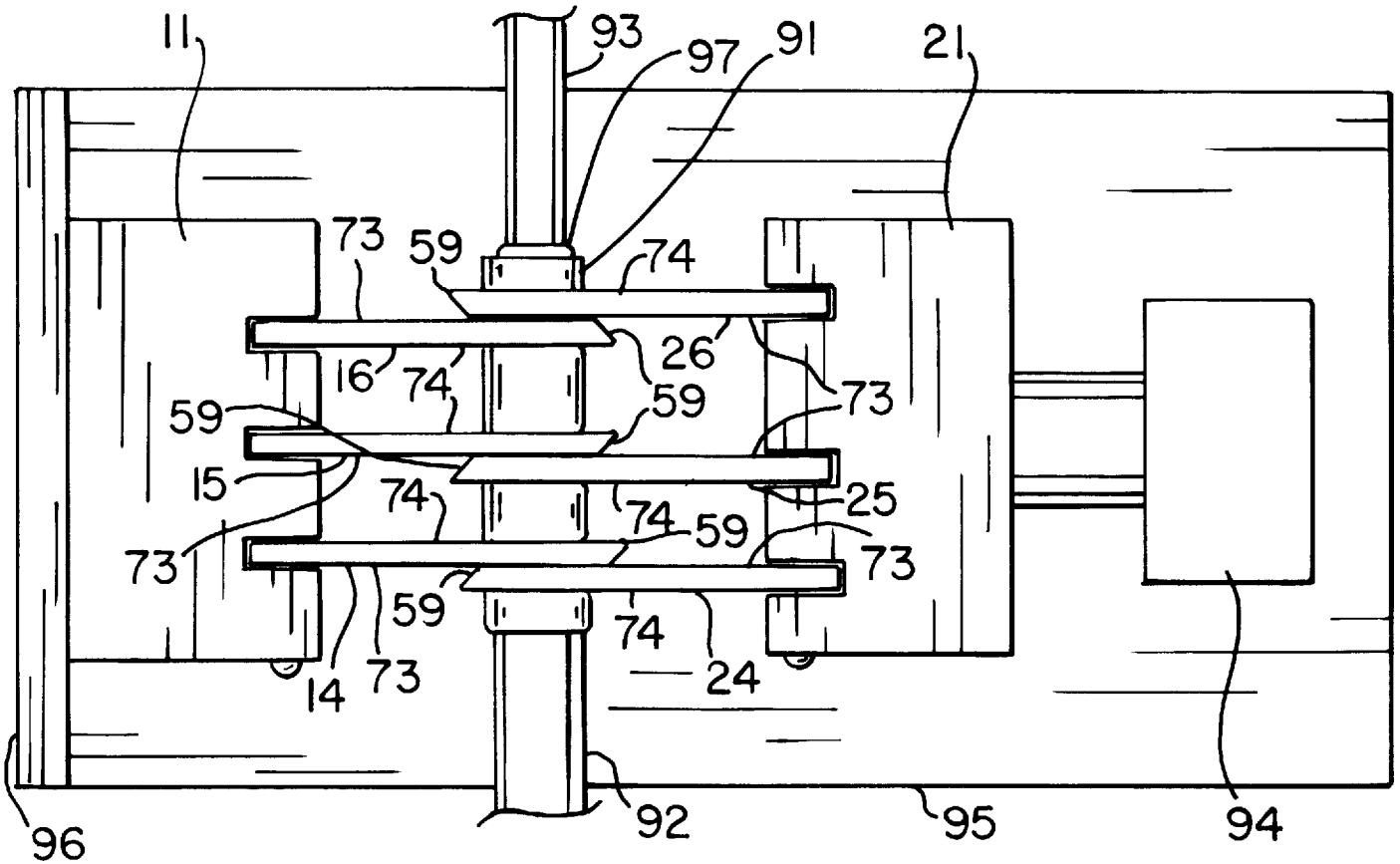
FIG. 5 is a top view of the invention in position to crimp a sleeve ferrule onto a hose as powered by a drive means.
Figure 6:
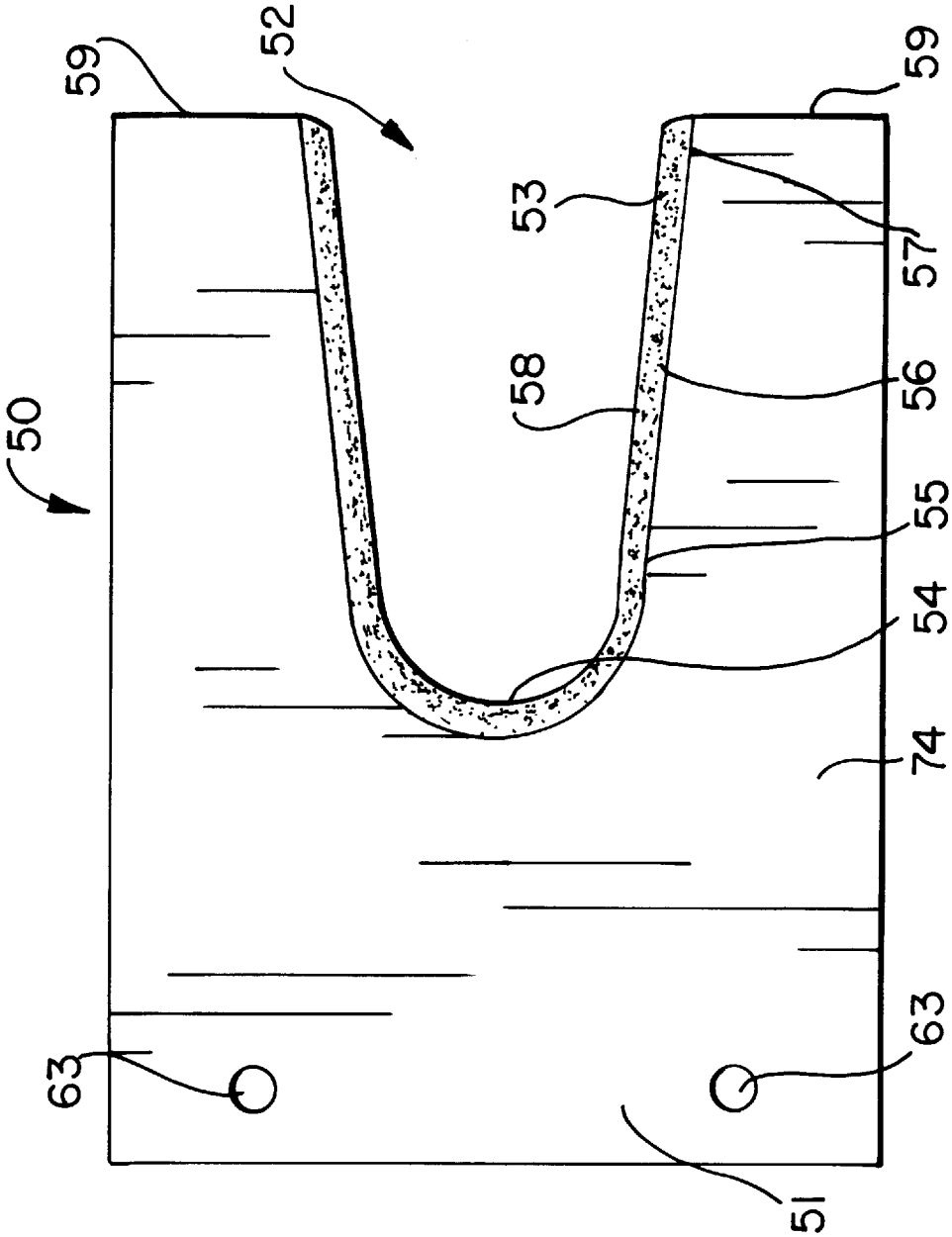
FIG. 6 is a side view of a crimping blade as removed from the base member.

As shown in FIGS. 4 and 5, the invention comprises in general two independent crimper assemblies, a first crimper assembly 10 and a second crimper assembly 20. First crimper assembly 10 comprises a first base member 11, which is shown as a generally rectangular block or housing structured to receive and retain a first set of crimper blades 13. First base member 11 can be of various shapes and configurations as long as the set of crimper blades 13 is rigidly secured therein. Preferably, the first set of crimper blades 13 is composed of three individual crimper blades 14, 15 and 16, which are mounted in parallel alignment extending from one side of the first base member 11. In like manner, the second crimper assembly 20 comprises a second base member 21 having a second set of crimper blades 23 composed of three individual crimper blades 24, 25 and 26 mounted in parallel alignment extending from one side of second base member 21. The sets of crimper blades 13 and 23 may be mounted or attached to the base members 11 and 21 in any suitable manner, but preferably each individual blade 14–16 and 24–26 is inserted into one of plural slots 12 or 22 cut into the base members 11. The main body 51 of each crimper blade 50, as shown in FIG. 6, is provided with one or more mounting apertures 63 which align with mounting apertures 61 cut into base members 11 and 21. A mounting pin or rod 62 is inserted through apertures 61 and 63 to secure the crimping blades 50 in place. This construction allows individual blades 50 to be removed from the base members 11 or 21 and replaced if necessary. The first crimper assembly 10 and second crimper assembly 20 are relatively disposed such that the first set of crimper blades 13 faces the second set of crimper blades 23, preferably by positioning each crimper assembly 10 and 20 on a generally planar support base or plate 95, which may be provided with channels or shoulders to guide the crimper assemblies 10 and 20 during linear movement. A detent flange 96 or other stop means is provided to retain the first crimper assembly 10 in a stationary manner as the second crimper assembly 20 is advanced towards it by a drive means 94. Drive means 94 may comprise any suitable means to deliver sufficient power to close the two crimper assemblies 10 and 20 about a sleeve ferrule 91/hose 92/tubing stem 93 assembly, such as for example a hydraulic or pneumatic piston, a drive screw, gears, etc. Drive means connector means 70, which may comprise an aperture to receive the ram of the hydraulic piston, allows power to be transferred from the drive means 70 to the second crimping assembly 20.

Figure 7:
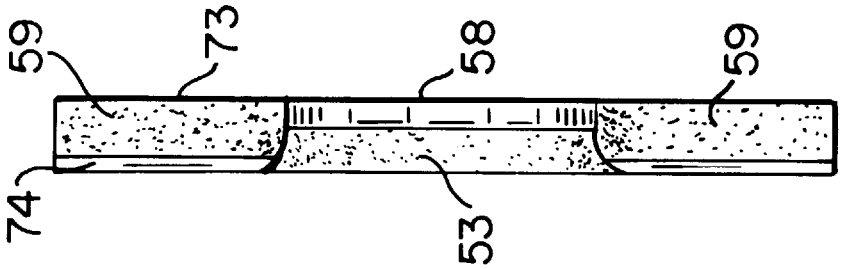
FIG. 7 is an end view of a crimping blade.

The particular configuration of each crimper blade 50 is shown in FIGS. 6 and 7. The crimper blades 50 must be constructed of a hard material, such as steel, which is capable of applying sufficient force to deform a sleeve ferrule 91. The crimper blade 50 comprises a main body 51 which is generally rectangular in configuration and relatively thin in cross-section, each blade 50 having an abutting side 73 and a non-abutting side 74. The end 59 of the crimper blade 50 not connected to base members 11 or 21 contains a crimping slot 52, generally centrally disposed, which is wide enough to receive the ferrule 91 with some amount of clearance. The major portion of the crimping slot 52 consists of an angled portion 56, such that the width of crimping slot 52 diminishes in the direction toward the interior of the main body 51 and base member 11 or 21. The crimping slot 52 terminates in a semi-circular portion 54, the radius of this semi-circular portion 54 determining the final external diameter of the crimping recess 98 in the sleeve ferrule 91 after it has been crimped by the device. Most preferably, the crimping slot 52 also comprises a first parallel portion 55 positioned between the semi-circular portion 54 and angled portion 56, over which the opposing edges of crimping slot 52 are in parallel alignment and separated by a distance equal to twice the radius of the semi-circular portion 54. Also most preferably, the crimping slot 52 comprises a second parallel portion 57 positioned between the angled portion 56 and the end 59 of crimping blade 50, over which the opposing edges of crimping slot 52 are in parallel alignment. Preferably end 59 is bevelled to the side of crimper blade 50 opposite that of the bevelled shoulder 53.

Figure 8:
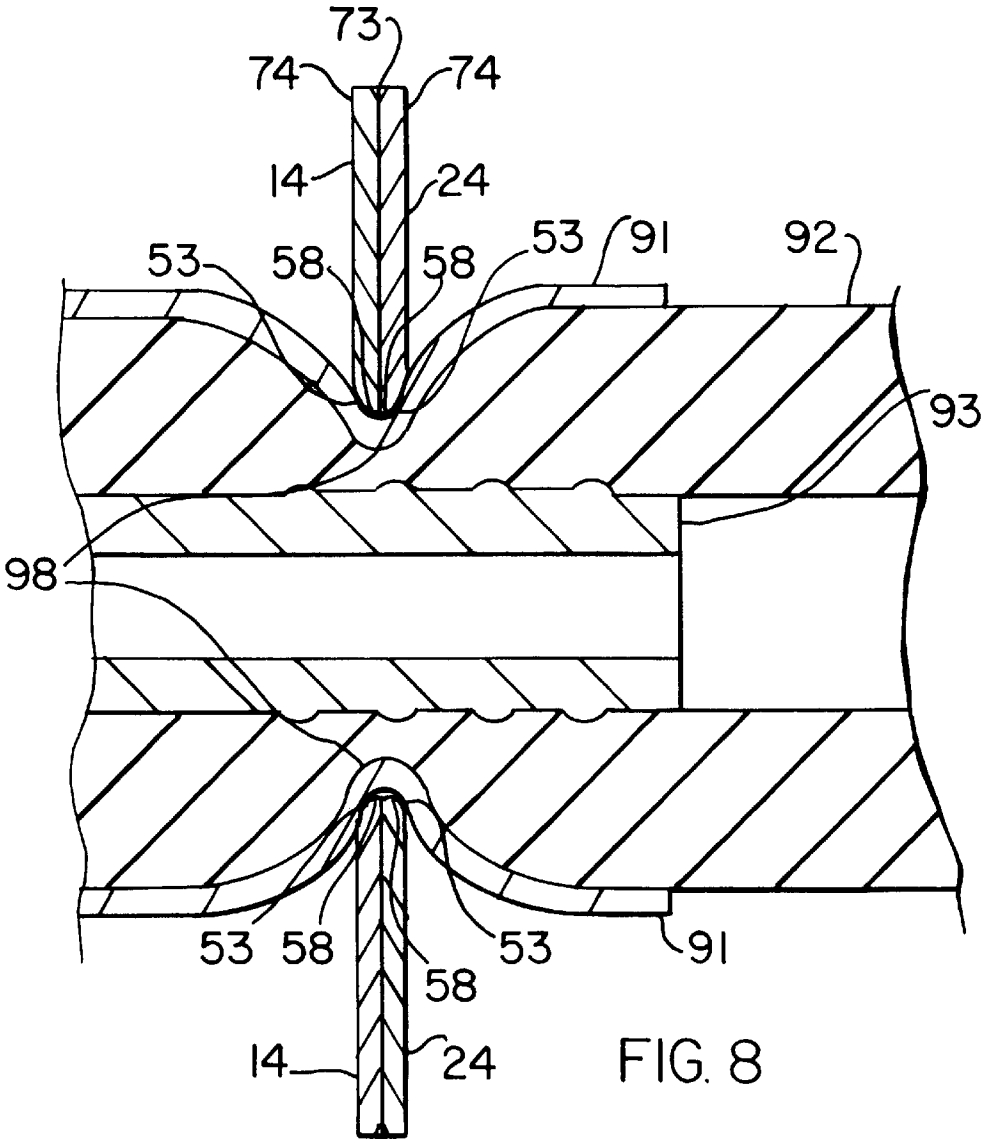
FIG. 8 is a partial cross-sectional view of an opposing pair of crimping blades showing the crimped sleeve ferrule.

The second parallel portion 57, angled portion 56, first parallel portion 55 and semicircular portion 54 which comprise crimping slot 52 all share a common edge 58, which is preferably radiused, on the abutting side 73 of blade 50. Completely co-extensive with this radiused edge 58 is a bevelled shoulder 53 on the non-abutting side 74 of blade 50. The bevelled shoulder 53 is preferably angled at about 15 degrees, such that the combination of radiused edge 58 and bevelled shoulder 53 presents a wedge-shaped profile against ferrule 91, as seen in FIG. 8. The particular dimensions of crimping slot 52 and crimping blade 50 are dependent on the size of the assembly being crimped, which will usually be one of four standard sizes.

Figure 10:
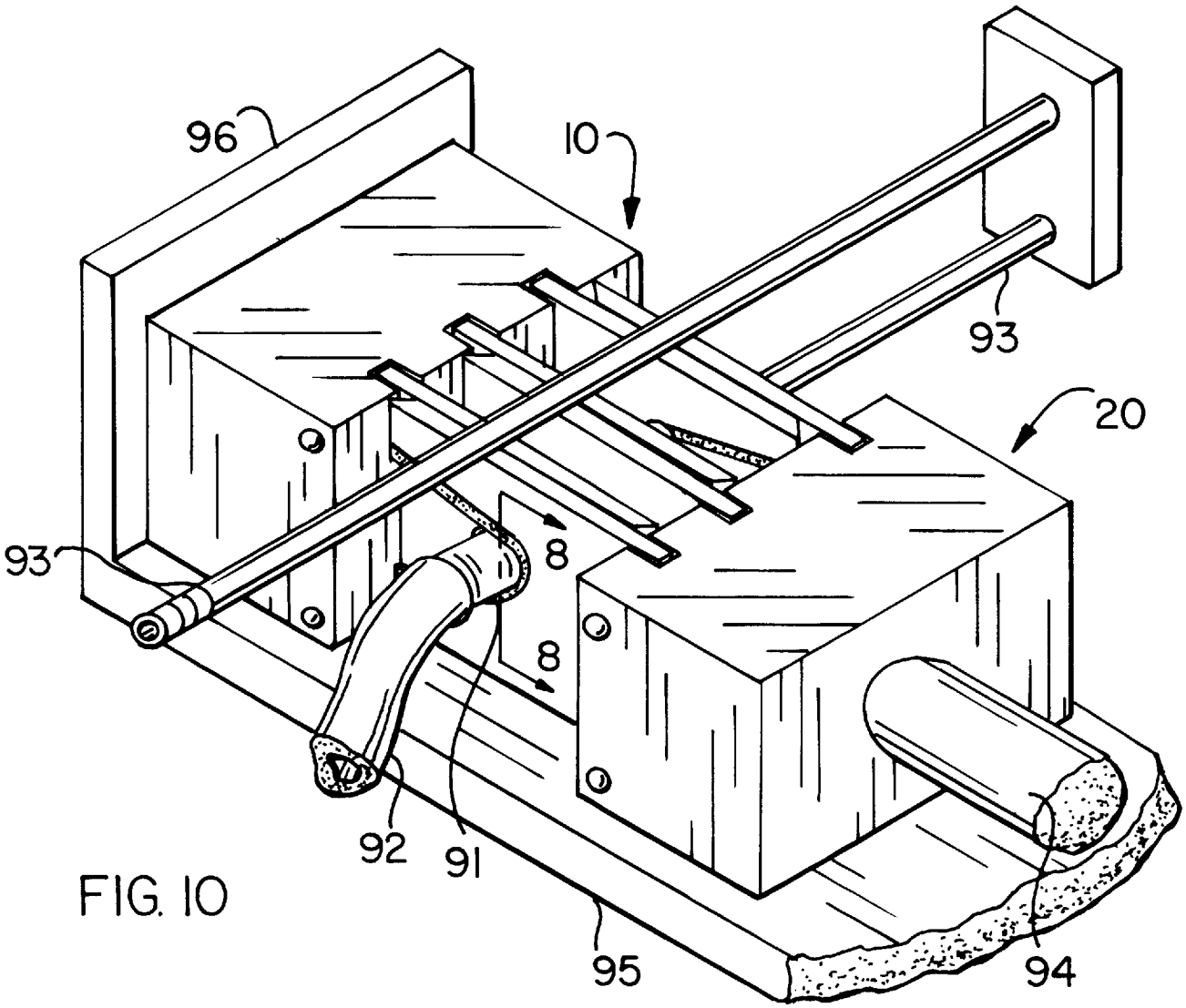
FIG. 10 is a perspective view showing application of the invention to a tubing construction having multiple adjacent tubing.

The crimper blades 50 are mounted in the crimper assemblies 10 and 20 in a particular manner, such that a blade 50 on the first crimper assembly 10 contiguously abuts a particular blade 50 on the second crimper assembly 20 when the two assemblies 10 and 20 are properly aligned and advanced to perform the crimping operation, as shown in FIGS. 5 and 10. A first crimper blade 14 of the first set of crimper blades 13 is positioned to abuttingly align with a first crimper blade 24 of the second set of crimper blades 23, a second blade 15 of first set 13 aligns with a second blade 25 of second set 23, and a third blade 16 of first set 13 aligns with a third blade 26 of second set 23. The crimping blades 14, 15 and 16 are disposed in base member 11 and the crimping blades 24, 25, and 26 are preferably disposed in base member 21 such that the separation between the conjunctions of blades 14/24 and blades 15/25 is approximately equal to the separation between the conjunction of blades 15/25 and blades 16/26. With this construction, the annular crimping recesses 98 formed in the ferrule 91 will likewise be separated an equal amount. Preferably, the separation distance between blades 14, 15 and 16 is not equal to the separation between blades 24, 25 and 26, since it is preferable that the outermost pair of blades 50 in one crimping assembly, shown in FIG. 5 as blades 24 and 26 in second crimping assembly 20, be separated a greater distance than the outermost set of blades in the other crimping assembly, shown herein blades 14 and 16 of first crimping assembly 10, such that blades 24 and 26 act to properly align and contain the first crimping assembly 10 and prevent relative movement in the transverse or axial direction. In this construction, the abutting sides 73 of each blade 24 and 26 will face inwardly and the abutting sides 73 of each blade 14 and 16 will face outwardly.

Each pairing of crimper blades 14/24, 15/25 and 16/26 are assembled such that the abutting side 73 with the radiused edge 58 of each crimping slot 52 in a blade 50 of the first set of crimping blades 13 abuts the abutting side 73 with the radiused edge 58 of each crimping slot 52 in a blade 50 of the second set of crimping blades 23, as seen in FIG. 8. With the blades 50 abutting in this manner, the bevelled shoulders 53 will always face outwardly in each blade pairing 14/24, 15/25 and 16/26, such that a tapered wedge-shape is forced against the ferrule 91. As paired in this manner, the bevelled ends 59 of opposing aligned blades 50 will cause the blades 50 to be directed toward the proper side of the pairing whenever the two crimping assemblies 10 and 20 are positioned and advanced, should a slight misalignment occur.

Figure 9:
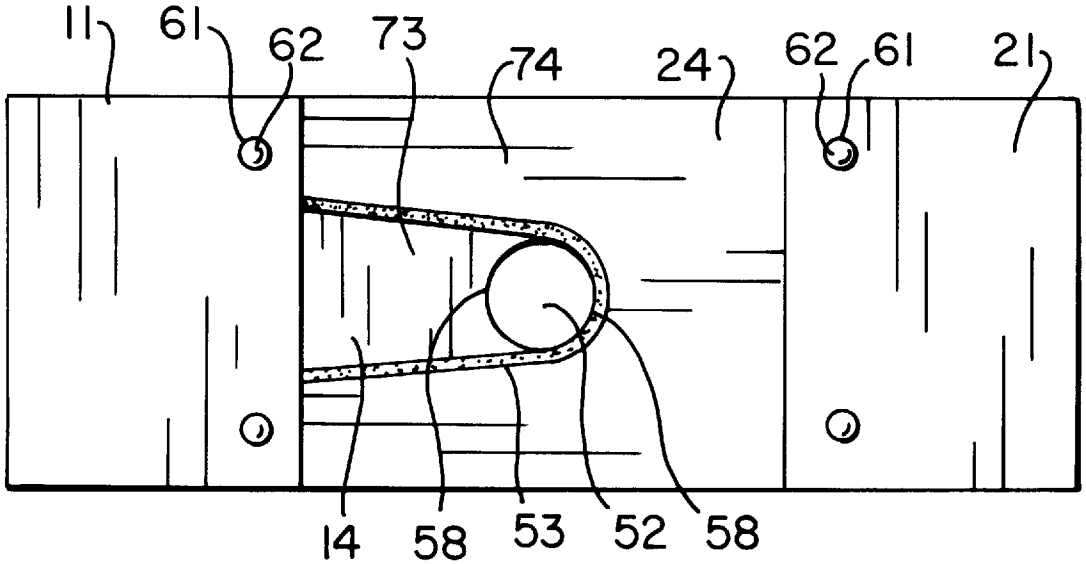
FIG. 9 is a side view of an opposing pair of crimping blades in the full crimp position.

A shown in FIG. 9, the distance from the central axis of semi-circular portion 54 to the end 59 of each blade 50 is preferably equal to the distance from the central axis to the base member 11 or 21. In this manner, when the opposing crimper assemblies 10 and 20 are advanced to perform the crimping operation, the ends 59 abut the base members 11 and 21 at the point where the opening formed by the conjunction of the semi-circular portions 54 of each of the contiguous blade pairings 14/24, 15/25 and 16/26 is a perfect circle, thus preventing the assemblies 10 and 20 from advancing beyond the point where the optimum circular crimp is achieved.

Figure 3:
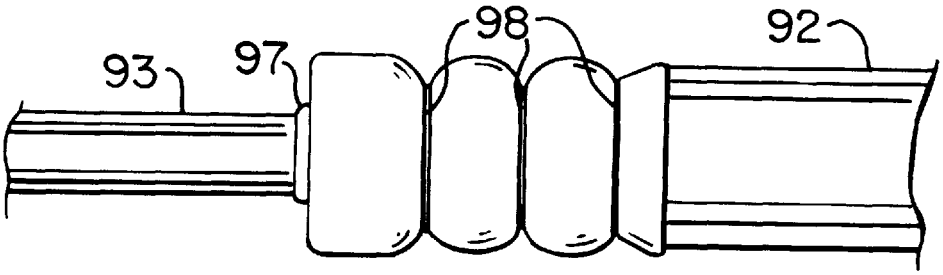
FIG. 3 is a side view showing a crimp as produced by the invention.

The crimping operation is performed by positioning a hose 92 within a sleeve ferrule 91 mounted, such as by a bead lock 97, onto a stem tubing 93. This assembly is then positioned with the ferrule 91 extending transversely through the crimping slots 52 of the first crimping assembly 10. The second crimping assembly 20 is then aligned and advanced toward the ferrule 91 and first crimping assembly 10 such that the second set of crimper blades 23 abuts in parallel manner the first set of crimper blades 13 with the ferrule 91/hose 92/stem 93 assembly enclosed by each pairing of crimper blades 50, as shown in FIG. 5. Power drive means 94 is activated and the second crimper assembly 20 is advanced toward the first crimper assembly 10, which is held in stationary position by detent flange 96 on support base 95. As the second crimper assembly 20 advances, the effective opening size of the slots 52 between each blade pairing 14/24, 15/25 and 16/26 decreases as the narrower parts of the angled portions 56 are advanced relative to each other. This movement initiates a crimping action such that three recesses 98 are formed in the ferrule 91, each recess 98 beginning first at two opposing points on the circumference and then advancing around the perimeter. As the two crimping assemblies 10 and 20 are further advanced and the effective opening size further decreases, the crimping recess 98 deepens. At the point of full advancement, as seen in FIGS. 9 and 10, the corresponding semicircular portions 54 of each blade pairing 14/24, 15/25 and 16/26, meet such that they share a common central axis, whereby the recesses 98 now formed are annular and circumscribe the ferrule 91 a full 360 degrees, as shown in FIG. 3. The sliding motion of the opposing sets of crimper blades 13 and 23 easily deform the metal sleeve ferrule 91, such that the hose 92 is tightly compressed at three positions against the internal stem 93, securely attaching the hose 92 to the stem 93. The second crimper assembly 20 is then retracted from the first crimper assembly 10 and the crimped assembly removed for use.

A major advantage of this invention is illustrated in FIG. 10, which shows a crimp being performed to join a hose 92 to a tubing stem 92 which is preformed in close conjunction with a second tubing member 93. Because the crimper device is comprised of two independent crimping assemblies 10 and 20 which can be separated completely and which have crimper blades 50 of relatively small dimensions, the crimper assemblies 10 and 20 can be assembled around the first tubing stem 93, the crimping operation performed and the crimper assemblies 10 and 20 disassembled to remove the crimped hose 92. The device only requires minimal clearance in all directions and can be used with a large number of complicated tubing configurations.

Figure 1:
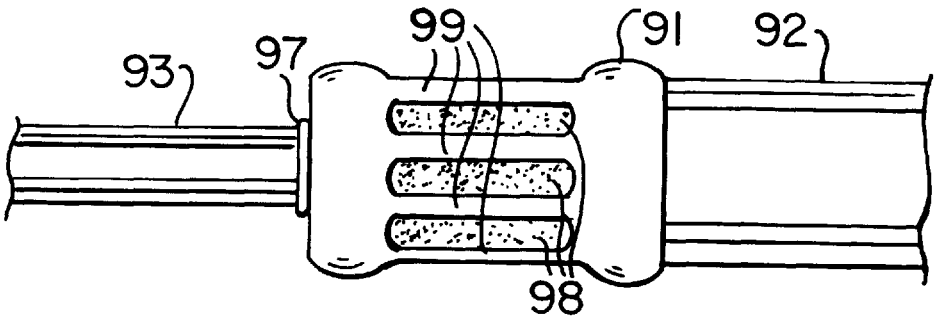
FIG. 1 PRIOR ART
FIG. 1 is a side view showing a linear crimp of known prior art.
Figure 2:
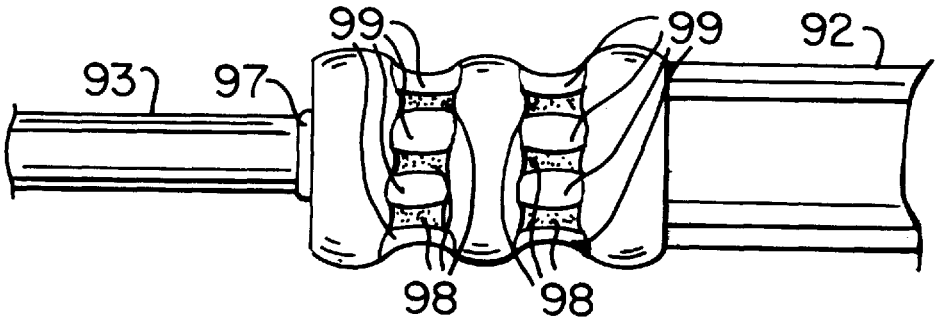
FIG. 2 PRIOR ART
FIG. 2 is a side view showing a bubble crimp of known prior art.

Another advantage of this invention is that the crimps produced are superior to standard crimping configurations, such as a linear crimp shown in FIG. 1 or a bubble crimp shown in FIG. 2. A crimp consists of deeply compressed recesses 98 and elevated crimp shoulders 99. As seen in the FIGS. 1 and 2, the prior art crimping patterns produce raised shoulders 99 extending in the longitudinal direction of the assembly. These raised shoulders 99 provide a potential leak pathway, since the hose 92 is not fully compressed in these regions. The totally annular crimp recesses 99 produced by the invention, as seen in FIG. 3, do not have any longitudinal crimp shoulders, thereby providing an improved configuration to prevent fluid loss.

I claim:

1. A crimper device for attaching a hose composed of a compressible material onto tubing stem having a deformable sleeve ferrule, the device comprising:

(A) a first crimper assembly comprising a first base member and a first set of crimper blades mounted therein, said first set of crimper blades comprising a plural number of crimper blades, each crimper blade having a crimping slot of diminishing width to receive a combined ferrule, hose and stem assembly for crimping;

(B) a second crimper assembly comprising a second base member and a second set of crimper blades mounted therein, said second set of crimper blades comprising a plural number of crimper blades, each crimper blade having a crimping slot of diminishing width to receive a combined ferrule, hose and stem assembly for crimping;

(C) support means for said first and said second crimper assemblies whereby said assemblies are disposed with said crimper blades of said first crimper assembly facing said crimper blades of said second crimper assembly; and (D) drive means to advance said first and said second crimper assemblies together against said combined ferrule, hose, stem assembly to deformably compress said ferrule against said hose and stem to form a circular crimp, where each of said crimper blades has an abutting side which contacts an abutting side of another of said crimper blades and a non-abutting side opposite from said abutting side which does not contact either an abutting or non-abutting side of another of said crimper blades whereby a space is defined between said non-abutting sides of adjacent crimper blades, and further where said first and said second crimper assemblies are disposed whereby one of each of said abutting sides of said crimper blades of said first crimper assembly contiguously abuts one of each of said abutting sides of said crimper blades of said second crimper assembly to define a pairing of crimper blades, each of said crimper blade pairings separated a distance from each other crimper blade pairing.

2. The device of claim 1, where said crimper blades are mounted in parallel alignment in said first crimper assembly and in said second crimper assembly.

3. The device of claim 1, where said crimping slot terminates in a semi-circular portion.

4. The device of claim 3, where said crimper blades limit the advancement of said first and said second crimper assemblies to the position where one of each of said semi-circular portions of said crimping slots of said crimper blades of said first crimper assembly join with one of each of said semi-circular portions of said crimping slots of said crimper blades of said second crimper assembly to form a circle.

5. The device of claim 3, where said crimping slot further comprises an angled portion and a first parallel portion connection said angled portion to said semi-circular portion.

6. The device of claim 5, where said crimping slot further comprises a second parallel portion connected to said angled portion.

7. The device of claim 1, where said crimping slot has a bevelled shoulder on said non-abutting side defining an edge of said abutting side, whereby within each of said crimper blade pairings the combination of each of said edges and said bevelled shoulders defines a wedge shape.

8. The device of claim 1, where said abutting sides of the outermost crimper blades of said second crimper assembly face inwardly and where said abutting sides of the outermost crimper blades of said first crimper assembly face outwardly.

9. The device of claim 7, where each of said edges is radiused.

10. The device of claim 1, where each of said crimping blades has a bevelled end on said abutting side to properly dispose said crimper blade pairings when said first and second assemblies are advanced together.

* * * * *